US007228846B2

(12) United States Patent
Kilgore

(10) Patent No.: US 7,228,846 B2
(45) Date of Patent: Jun. 12, 2007

(54) APPARATUS, SYSTEM, AND METHOD FOR REDUCING PRESSURE PULSATIONS AND ATTENUATING NOISE TRANSMISSION IN A FUEL SYSTEM

(75) Inventor: Jason T. Kilgore, Newport News, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 98 days.

(21) Appl. No.: 10/859,138

(22) Filed: Jun. 3, 2004

(65) Prior Publication Data

US 2004/0216803 A1 Nov. 4, 2004

Related U.S. Application Data

(62) Division of application No. 10/235,502, filed on Sep. 6, 2002, now Pat. No. 6,745,798.

(60) Provisional application No. 60/318,074, filed on Sep. 6, 2001.

(51) Int. Cl.
*F02M 63/00* (2006.01)
*F02M 63/02* (2006.01)

(52) U.S. Cl. ..... 123/447; 123/456

(58) Field of Classification Search ..... 123/447, 123/456, 463, 468, 469; 138/26, 30; 141/1, 141/67

See application file for complete search history.

(56) References Cited

U.S. PATENT DOCUMENTS 2,407,276 A 9/1946 Hendel et al. ..... 138/26
2,730,132 A 1/1956 Marcus et al. ..... 138/26
2,931,391 A * 4/1960 Hendel ..... 138/26
4,142,497 A * 3/1979 Long ..... 123/456
4,234,427 A * 11/1980 Boehme ..... 210/198.2
4,299,253 A 11/1981 Burton ..... 138/30
4,427,029 A * 1/1984 Charney et al. ..... 138/30
4,561,251 A 12/1985 Moret et al. ..... 60/537
4,642,035 A 2/1987 Nyquist ..... 417/312
5,032,283 A 7/1991 Scott et al. ..... 210/656
6,059,547 A 5/2000 Konishi et al. ..... 417/540
6,079,450 A 6/2000 Onishi et al. ..... 138/30
6,125,890 A * 10/2000 Cooper et al. ..... 138/131
6,167,903 B1 * 1/2001 Newman ..... 137/351
6,240,964 B1 * 6/2001 Cooper et al. ..... 138/30
6,360,777 B1 3/2002 Bae ..... 138/30
6,470,859 B2 10/2002 Imura et al. ..... 123/467
6,615,800 B1 * 9/2003 Frank et al. ..... 123/456

* cited by examiner

*Primary Examiner*—Mahmoud Gimie

(57) ABSTRACT

An apparatus, system, and method of damping pressure pulsations and attenuating noise transmission in a fuel supply system. The apparatus includes a first end in fluid communication with a fuel supply line, a second end in fluid communication with a manifold, and a body that couples in fluid communication the first and second ends. The first end is adapted to receive fuel from a pump. The second end is adapted to supply the fuel to a plurality of nozzles in individual fluid communication with the manifold. And the body includes a tube that is arranged in a helix around a central axis.

9 Claims, 6 Drawing Sheets

APPARATUS, SYSTEM, AND METHOD FOR REDUCING PRESSURE PULSATIONS AND ATTENUATING NOISE TRANSMISSION IN A FUEL SYSTEM

CROSS-REFERENCE TO RELATED APPLICATIONS

This application is a divisional application which claims the benefits of 35 U.S.C. §§ 120 and 121 of prior application Ser. No. 10/235,502 filed on Sep. 6, 2002 now U.S. Pat. No. 6,745,798, which the entirety of the prior application is incorporated by reference herein. This application claims the benefit of the earlier filing date of U.S. Provisional Application No. 60/318,074, filed 6 Sep. 2001 and titled "A Coiled Fuel Communication Device Constructed for the Reduction of Pressure Pulsation and Noise Transmission," the entirety of which is incorporated by reference herein.

FIELD OF THE INVENTION

This disclosure relates to reducing pressure pulsations and noise transmission in a fluid system, and more particularly, to damping pressure pulsations and attenuating noise transmission in a fuel supply system, e.g., on an automotive vehicle.

BACKGROUND OF THE INVENTION

It is believed that noise has traditionally been a problem in most fuel delivery systems. In such systems, each moving component has the potential to create or propagate noise. Examples of such fuel system components include fuel injectors, pressure regulators, fuel pumps, and check valves. Additionally, it is believed that mechanical vibration that is imparted to a fuel system can generate noise at its own signature frequency.

One type of known pressure pulsation damper includes a spring and a diaphragm. However, this type of damper suffers from a number of deficiencies. For example, it is believed that this type of damper is effective only for lower frequency pressure pulsations, i.e., in a range of 20-100 Hertz. Such lower frequency pulsations can be caused by the operation of fuel injectors. The effective damping range for a spring and diaphragm type pressure pulsation damper is believed to be achieved as a result of a relatively high degree of flexibility or pliability. However, this same flexibility or pliability causes spring and diaphragm type pressure pulsation dampers to be ineffective for damping higher frequency pulsations. Applicant has recognized that a more rigid structure is required for damping such higher frequency pulsations.

It is believed that for fuel systems there is a need to damp pressure pulsations and attenuate noise transmission in a higher frequency range, e.g., 200-500 Hertz. This higher frequency range is believed to be well above the operating range of spring and diaphragm type pressure pulsation dampers.

SUMMARY OF THE INVENTION

The present invention provides an apparatus damping pressure pulsations and attenuating noise transmission in a fluid supply system. The apparatus includes a first end in fluid communication with a fluid supply line, a second end in fluid communication with a manifold, and a body that couples in fluid communication the first and second ends.

The first end is adapted to receive fluid from a pump. The second end is adapted to supply the fluid to a plurality of nozzles in individual fluid communication with the manifold. And the body includes a tube that is arranged in a helix around a central axis.

The present invention also provides a system that delivers fuel to an internal combustion engine. The system includes a tank that stores fuel at a first pressure, a fuel injector that dispenses the fuel, and an apparatus in fluid communication between the tank and the fuel injector. The fuel is supplied to the fuel injector at a second pressure. The apparatus includes a first end in fluid communication with the tank, a second end in fluid communication with the fuel injector, and a body that couples in fluid communication the first and second ends. The body includes a tube arranged in a helix around a central axis. And the apparatus damps pressure pulsations and attenuates noise transmission due to variation in the second pressure.

The present invention also provides a system for delivering fuel to an internal combustion engine. The system includes a tank that stores fuel, a fuel injector that dispenses the fuel, and an apparatus in fluid communication between the tank and the fuel injector. The apparatus reduces pressure pulsations to an approximate range of ±10.0 kilopascals, or attenuates noise by approximately 10 decibels, as compared to a system without an embodiment according to the present invention, over an approximate range of 160-250 hertz.

The present invention also provides a method of damping pressure pulsations and attenuating noise transmission in a fuel delivery system. The method includes supplying fuel from a tank to at least one fuel injector, the supplying includes conveying the fuel through a coil having at least one loop, and uncoiling and recoiling the coil in response to variations in fuel pressure. The uncoiling and recoiling provides infinitesimal volumetric changes in the coil.

The present invention also provides a method of damping pressure pulsations and attenuating noise transmission in a fuel delivery system. The method includes supplying fuel from a tank to at least one fuel injector, the supplying includes conveying the fuel through a tube curving around a central axis, and straightening and recurving the tube in response to variations in fuel pressure. The straightening and recurving provides infinitesimal volumetric changes in the tube.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT

Figure 1A:
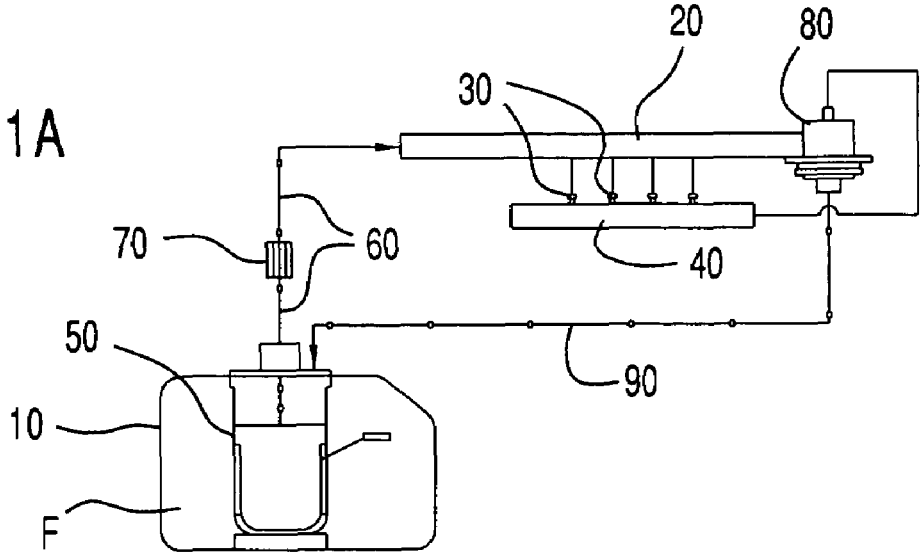
FIGS. 1A-1F are schematic illustrations that depict different types of fuel systems.

There are at least two different types of fluid systems. A fixed volume of fluid that is captured within a closed system can characterize a first type of fluid system. An example of these first types of fluid systems is a "hydraulic system," which generally reuses a substantially incompressible fluid. For example, brake systems on automotive vehicles can include a fixed volume of substantially incompressible hydraulic fluid that is captured within a closed system that includes a reservoir, a master cylinder, and at least one slave cylinder.

A fluid flow in an open system can characterize a second type of fluid system. It is frequently the case that the fluid used in one of these second types of fluid systems is irreversibly converted by a process into a different form, and thus cannot be reused by the same process. For example, a fuel system on an automotive vehicle can include a fuel tank that supplies gasoline to an internal combustion engine, which irreversibly converts the gasoline into work, heat, and combustion by-products.

FIGS. 1A-1F show examples of fuel systems that can be used on automotive vehicles for supplying fuel F from a tank 10 to a fuel rail 20. The fuel rail 20 distributes the fuel F to fuel injectors 30, which can meter the amount of the fuel F that is injected into an internal combustion engine 40. The supply of the fuel F to the fuel rail 20 can be via pumps 50, supply lines 60, and filters 70. Pressure regulators 80 can be used to control the pressure of the fuel F in the fuel rail 20, and excess fuel F can be returned to the tank 10 via return lines 90. As used herein, like reference numerals indicate like elements throughout.

Figure 1B:
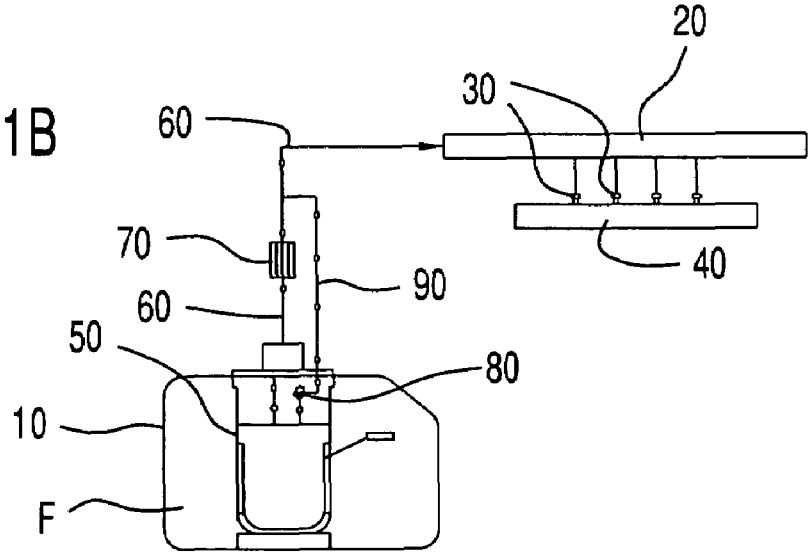
Figure 1C:
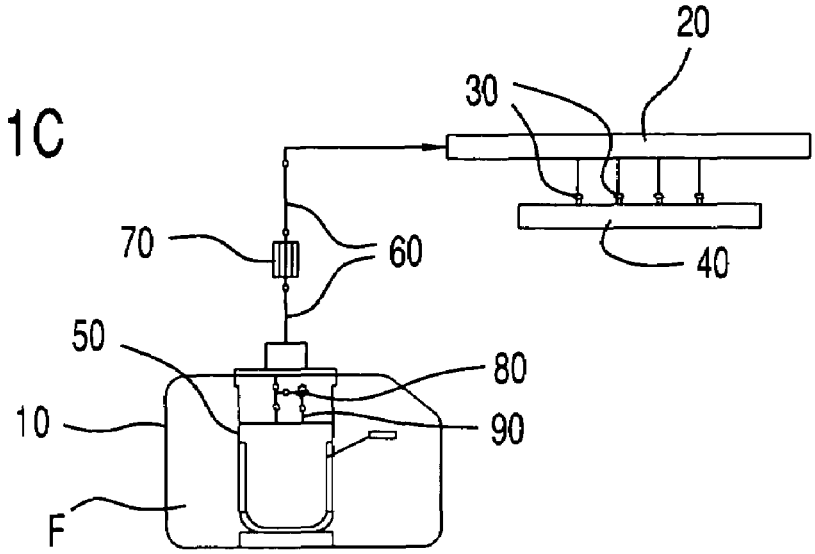
Figure 1D:
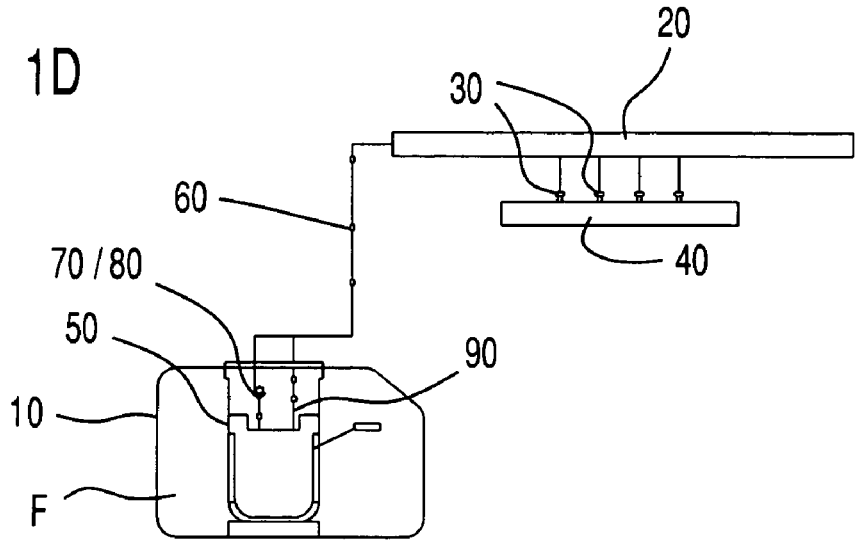
Figure 1E:
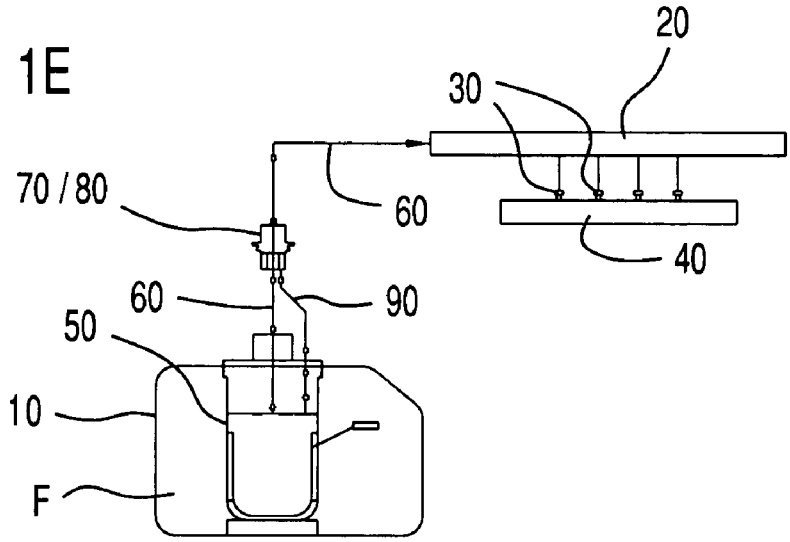
Figure 1F:
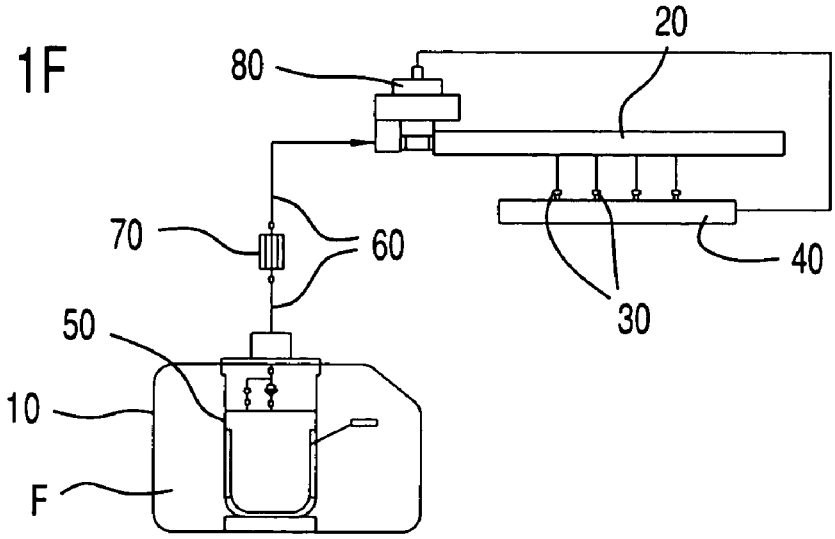

FIG. 1A shows a return fuel system. FIG. 1B shows a no-return fuel system with the pressure regulator 80 located in the tank 10, and the filter 70 filtering all of the fuel F that is provided by the pump 50. FIG. 1C shows a no-return fuel system with the pressure regulator 80 located in the tank 10, and the filter 70 filtering only the fuel F that is provided to the fuel rail 20. FIG. 1D shows a no-return fuel system with the pressure regulator 80 and the filter 70 provided in combination and located in the tank 10. FIG. 1E shows a no-return fuel system with the pressure regulator 80 and the filter 70 provided in combination and located outside the tank 10. And FIG. 1F shows a no-return fuel system with a pressure regulator 80*a* that admits to the fuel rail 20 only the fuel that is dispensed by the fuel injectors 30.

Figure 2:
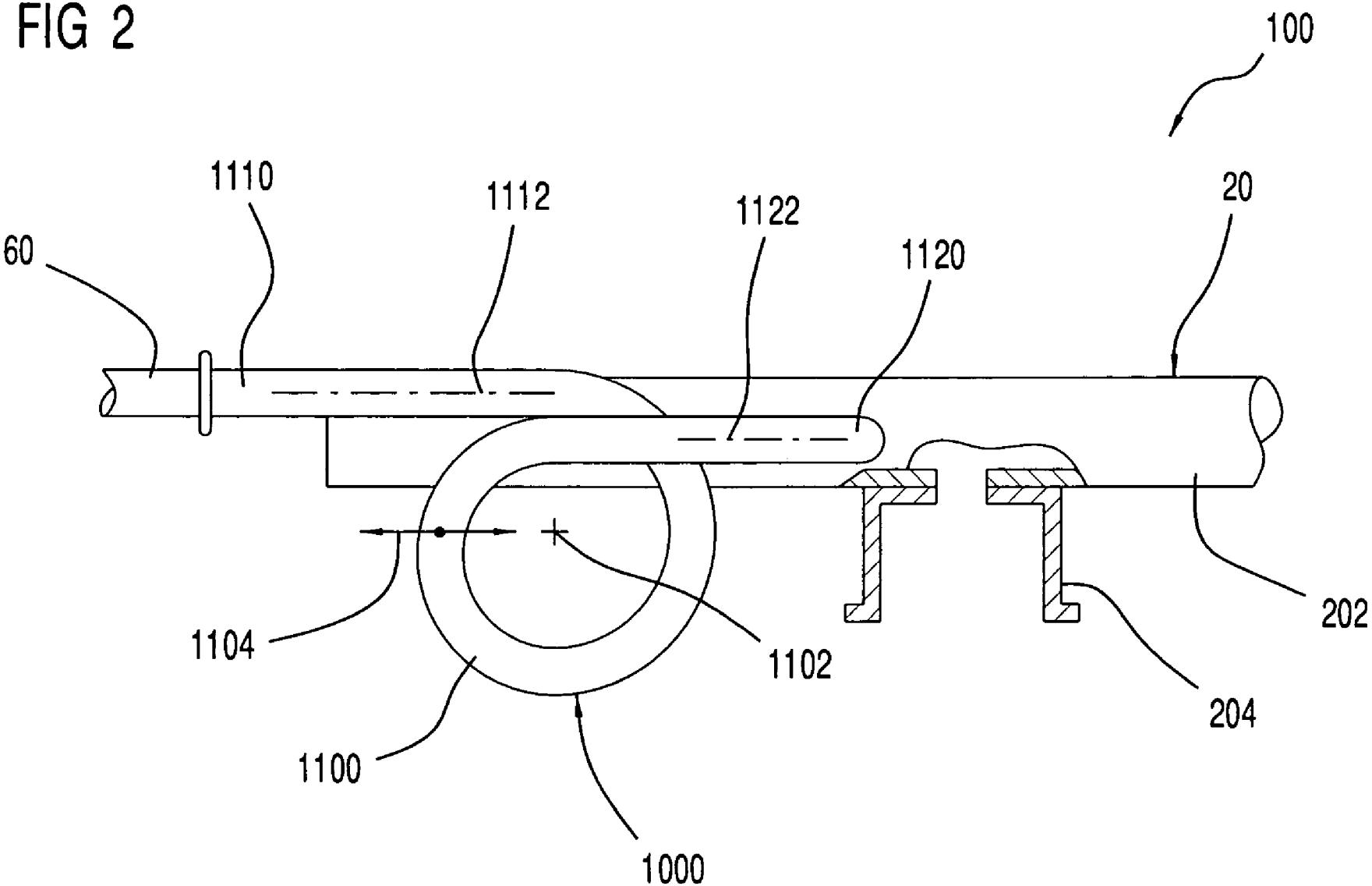
FIG. 2 is a schematic illustration that shows a portion of fuel system according to a preferred embodiment of the present invention.

Referring to FIG. 2, there is shown a portion of a preferred embodiment of a fuel system 100 according to the present invention. The system 100 includes a fuel rail 20 and an apparatus 1000 that damps pressure pulsations and attenuates noise transmission. The apparatus 1000 can be installed at almost any location on the fuel supply side of the fuel systems shown in FIGS. 1A-1F. Apparatus 1000 can be used in addition to, or in lieu of, a spring and diaphragm type damper. Apparatus 1000 attenuates noise at all frequencies including the lower frequency, higher amplitude pulses that are more effectively damped by known spring and diaphragm type dampers.

The fuel rail 20 includes a body 202 and at least one cup 204. As shown with respect to FIGS. 1A-1F, the body 202 receives fuel F that is supplied under pressure. And the cup 204 connects a fuel injector to the body 202.

The apparatus 1000, which can be a coupling between the supply line 60 and the body 202, includes at least one coil 1100 arranged around a generally central axis 1102, a first end 1110 in fluid communication with the supply line 60, and a second end 1120 in fluid communication with the body 202 of the fuel rail 20. The first end 1110 extends from the coil 1100 along a first axis 1112, and the second end 1120 extends from the coil 1100 along a second axis 1122. Preferably, the coil 1100 is in the shape of a helix, the first and second axes 1112,1122 are parallel to one another (when viewed along the central axis 1102), and the first and second ends 1110,1120 extend from the coil 1100 in relatively opposite directions.

Alternatively, the first and second axes 1112,1122 can be parallel to one another, when viewed along the central axis 1102, and concurrently lie in respective planes that are relatively oblique with respect to one another. Moreover, the first and second axes 1112,1122 may be defined by a plurality of straight and arcuate segments, e.g., the first and second axes 1112,1122 may extend from the coil 1100 along a complex two- or three-dimensional path. And it is possible that at least a finite portion of the helix can lie in single plane, e.g., a curl spiraling around the central axis 1102.

An angular measure of the helix of the coil 1100, i.e., measured around the central axis 1102 and between the first and second axes 1112,1122, is preferably at least 360 degrees. Preferably, the angular measure of the helix of the coil 1100 is a non-zero integer multiple of 360 degrees, such that the coil 1100 may include more than one loop. The helix of the coil 1100 can extend in a clockwise manner, e.g., a positive integer multiple of 360 degrees, or can extend in a counterclockwise manner, e.g., a negative integer multiple of 360 degrees. The coil 1100 can also extend an additional fraction of a loop, i.e., such that the angular measure of the helix is greater than 360 degrees and the first and second axes 1112,1122 extend obliquely with respect to one another, when viewed along the central axis 1102.

As pressure varies inside the coil 1100, there is a tendency for the coil 1100 to flex in such a manner as to uncoil and recoil itself, thus coil 1100 expands or contracts in a radial direction with respect to central axis 1102 such that the loop diameter grows or shrinks. An example of flexure in the coil 1100 is shown by double-headed arrow 1104 in FIG. 2. In response to variations in the pressure of the fuel F, the coil 1100 uncoils when pressure increases and recoils in when the pressure decreases; preferably, the uncoiling and recoiling occur substantially instantaneously with the pressure increases and decreases.

For example, since a radially outer portion of the fluid passageway has a larger surface area than a radially inner portion of the fluid passageway, an increase in the pressure of fuel F in coil 1100 will cause a greater force to be applied to the outer portion than to the inner portion. In turn, this will cause coil 1100 to uncoil or expand radially with respect to central axis 1102. Other constructions, e.g., partial helixes extending less than 360 degrees, which experience similar effects due to pressure fluctuations can also provide pressure pulsation reduction and attenuate noise.

There are at least two advantages that are achieved with coil 1100: 1) the cyclic uncoiling and recoiling provides infinitesimal volumetric changes that absorb energy that is created by fluctuations in the pressure of the fuel F in the fuel rail 20; and 2) the configuration, e.g., shape and number of loops, and characteristics, e.g., stiffness, of the coil set the functional frequency range of the coil 1100 to damp pulsations and noise. Thus, it is possible to "tune" the coil 1100 for a specific fuel system or frequency range.

The frequency response of a damper is related to the spring rate and the mass of the system according to the following equivalent equations:

$$f_o = \sqrt{\frac{k}{m}} \text{ or } f_o^2 = \frac{k}{m}$$

where $f_o$ is the operating natural frequency (or optimum operating frequency), k is the spring rate of the body, and m is the inertial mass of the system. In particular, the spring rate k for coil 1100 is determined with respect to axis 1102. Factors that affect the spring rate k or stiffness of coil 1100 include tube diameter, material thickness, material type, loop diameter, number of loops, and any constraints, e.g., mounting fixtures, acting on the system. The mass m is determined by the mass of the moving portion of the coil 1100. Therefore, as the spring rate k of the coil 1100 is increased, the square of the frequency response will increase proportionally.

According to a preferred embodiment, the coil 1100 is constructed from stainless steel 303/304 as a single loop having a loop diameter of approximately 2.5 inches, a 0.375 inch tube diameter, and a wall thickness of 0.035 inches. The cross-sectional shape of coil 1100 is preferably an annulus, i.e., with concentric inside and outside diameters.

Alternatively, coil 1100 can be constructed of low carbon steel, and can have a wall thickness of 0.5-2.0 millimeters. The coil 1100 can also have tubular cross-sectional shapes other than annular, e.g., triangular, rectangular, etc., and the wall thickness can vary around the cross-sectional shape of the tube.

Figure 3:
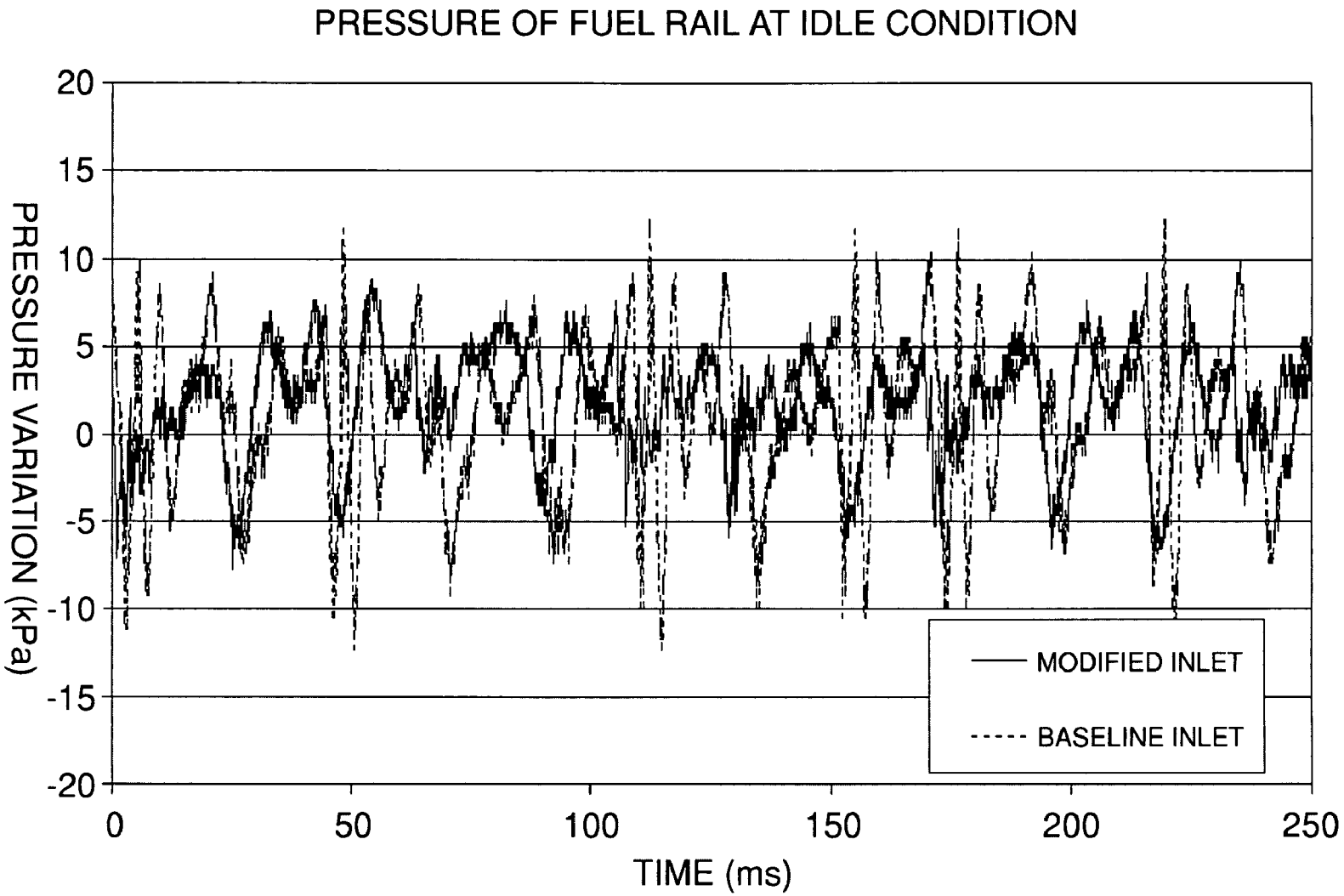
FIG. 3 is a graph that depicts an advantage of the preferred embodiment as shown in FIG. 2 with respect to pressure pulsation.

FIG. 3 compares pressure variation with respect to time for a fluid system that is fitted with the coil 1100 and to the same fluid system except that it is not fitted with the coil 1100. In each case, the pressure of the fuel F in the fuel rail 20 was measured at conditions that simulate idling of the internal combustion engine 40. The maximum amplitude of pressure pulsations is reduced in the system that is fitted with the coil 1100 to an approximate range of ±7.5 kilopascals, whereas the range of pressure pulsations in the system that is not fitted with the coil 1100 is approximately ±12.5 kilopascals. Thus, the coil 1100 achieves a reduction in the pressure variation.

A typical fuel delivery system for an internal combustion engine 40 in an automotive vehicle can operate at a nominal fuel pressure of 60 pounds per square inch, and have a pressure fluctuation of ±20% relative to the nominal fuel pressure. Coil 1100 reduces the pressure fluctuations, thereby reducing resonance in the fuel rail 20 and thus attenuating the noise associated with the resonance. Coil 1100 can also shift the pressure pulsations such that resonance in the fuel rail 20 is moved out of an audible frequency range.

Figure 4:
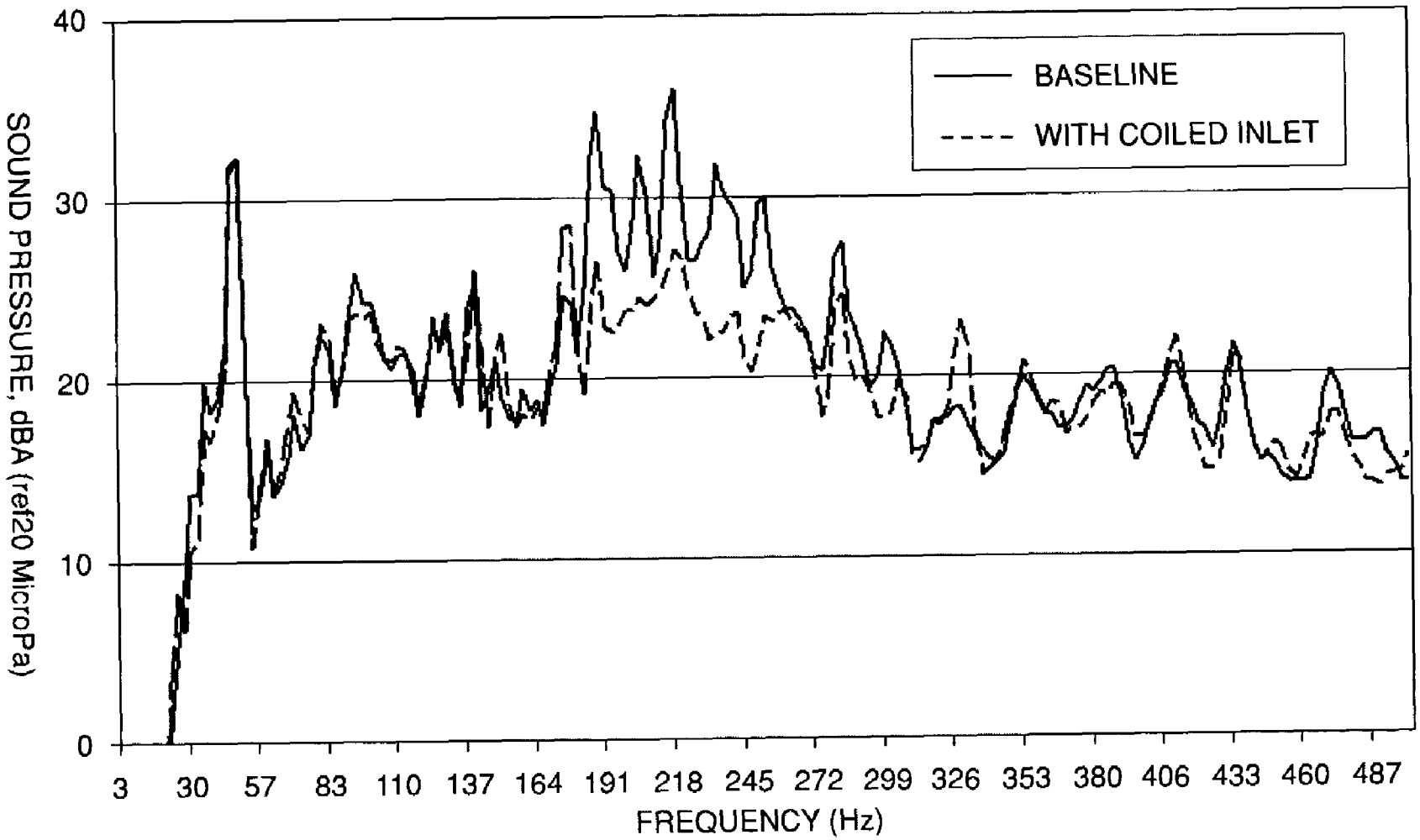
FIG. 4 is a graph that depicts an advantage of the preferred embodiment as shown in FIG. 2 with respect to noise reduction.

FIG. 4 compares the relative sound pressure of systems with and without the coil 1100. In each case, noise was measured as a function of frequency via a microphone in a vehicle cockpit that is susceptible to transmitting and receiving sound in a frequency range between 100 and 500 hertz. In the range of 160-250 hertz, noise is reduced by up to 10 decibels or more in the system fitted with the coil 1100, as compared to the system that was not fitted with the coil 1100.

Figure 5A:
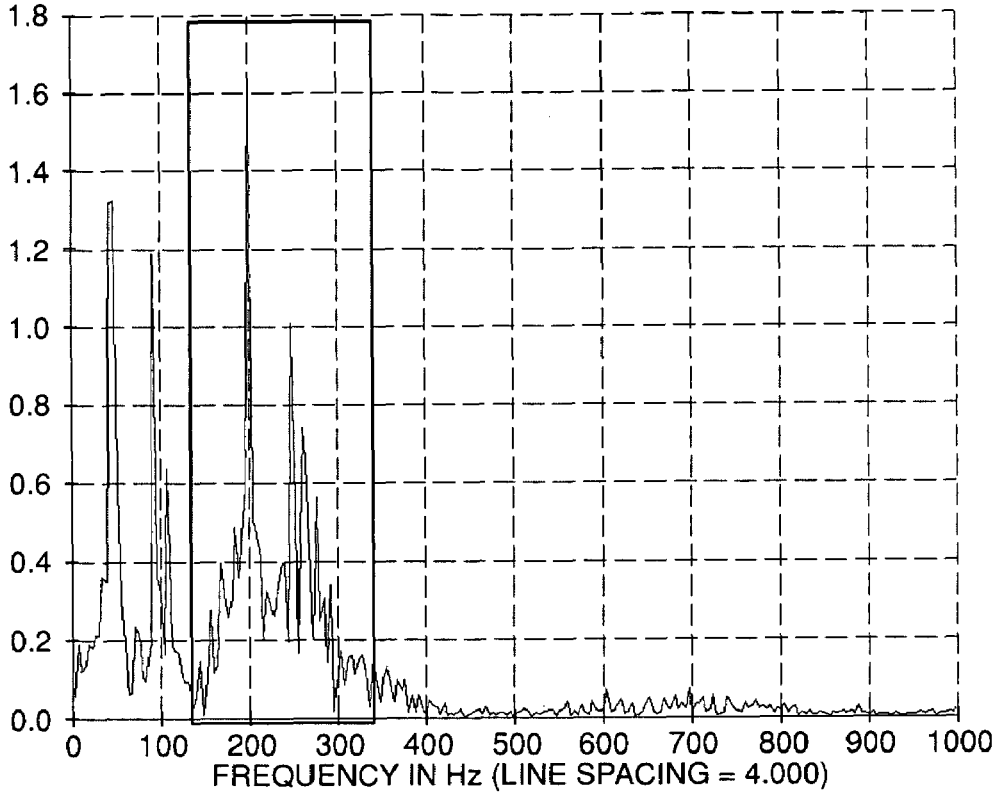
FIGS. 5A and 5B are comparative graphs that present empirical data demonstrating the advantages depicted in FIGS. 3 and 4.
Figure 5B:
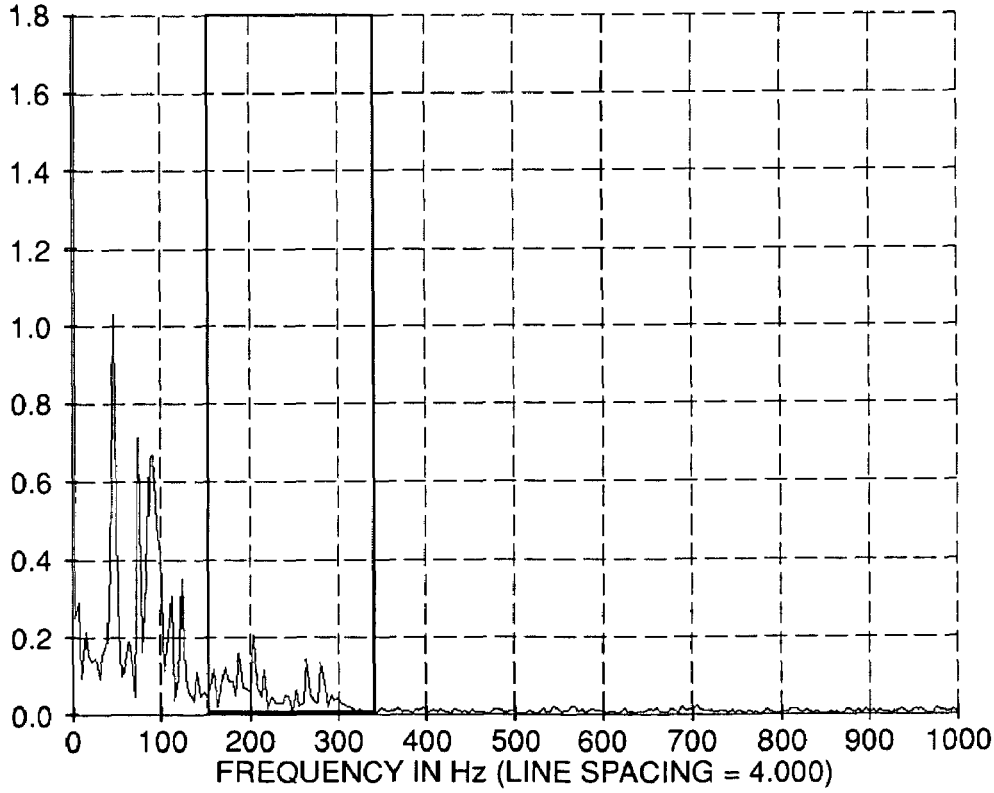

Referring also to FIGS. 5A and 5B, it can be seen that a reduction in noise in the cockpit is achieved as a result of the ability of the coil 1100 to respond to higher frequency noise than is possible with known spring and diaphragm type pressure pulsation dampers. FIGS. 5A and 5B illustrate analyses of pressure pulsation data using the Fast Fourier Transform (FFT) method. Essentially, FIGS. 5A and 5B illustrate how often each frequency occurs within a test period. In particular, FIG. 5A is an analysis of the system without coil 1100, and FIG. 5B is an analysis of the system with coil 1100. Based on this analysis, the data shows that the coil 1100 is effective in attenuating pulsation in the same frequency range as the acoustic noise (see FIG. 3). Thus, there is conclusive empirical data supporting the ability of the coil 1100 to reduce pressure pulsation and to attenuate noise.

At least six advantages that are achieved by the coil 1100. First, the coil 1100 is a fluid communication device that can be designed to reduce pressure pulsation and noise transmission in a fuel delivery system. Second, the coil 1100 can be constructed of hollow, tubular materials such that fluid passes through its cross-section. Third, the coil 1100 flexes as a means of reducing pressure pulsation and noise transmission. Fourth, the coil 1100 can be "tuned" to damp higher frequency pressure pulsation and noise. Fifth, the coil 1100 can be used as a coupling between components of a fuel delivery system. And sixth, the coil 1100 can be "in-line" installed, e.g., installed along a fuel supply line.

Thus, the coil 1100 can reduce or eliminate the need for known pressure pulsation dampers in fuel delivery systems, can reduce pressure pulsations and noise in fuel delivery systems, and can be installed at various and multiple locations in a fuel delivery system. Specifically, the coil 1100 can be installed at almost any location on the fuel supply side of the fuel systems shown in FIGS. 1A-1F, for example.

Whereas the aforementioned preferred embodiments are characterized by fluid flow in an open fluid system, the present invention is also applicable to closed fluid systems that reuse the same fluid, to fluid systems that use compressible as well as incompressible fluids, and to fluid systems that do not convert the fluid. The wide ranging applicability of the present application is at least partially facilitated by the ability to "tune" the coil 1100 for a particular system.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A method of damping pressure pulsations and attenuating noise transmission in a fuel delivery system for a fuel-injected internal combustion engine, the method comprising:

supplying fuel from a tank to at least one fuel injector connected to the internal combustion engine for delivering fuel to the internal combustion engine, the supplying includes conveying the fuel through a coil having at least one loop, the coil having a first end extending along a first axis and fluidly communicating with a fuel supply line, and a second end extending along a second axis and fluidly communicating with a fuel rail coupled to the at least one fuel injector, wherein the first and second axes are fixed relative to each other; and radially uncoiling and recoiling the coil with respect to a central axis that is fixed relative to the first and second axes in response to variations in fuel pressure within the coil, the uncoiling and recoiling providing infinitesimal volumetric changes in the coil.

2. The method according to claim 1, wherein the infinitesimal volumetric changes absorb energy created by the variations in fuel pressure during the supplying.

3. The method according to claim 1, further comprising:

tuning the coil to damp pressure pulsations and attenuate noise transmission in a pre-selected frequency range.

4. The method according to claim 3, wherein the pre-selected frequency range is approximately 160-250 hertz.

5. The method according to claim 3, wherein the tuning comprises at least one of the group consisting of selecting a loop diameter of the coil, selecting an outside cross-section diameter of the coil, selecting an inside cross-section diameter of the coil, and selecting a material type of the coil.

6. A method of damping pressure pulsations and attenuating noise transmission in a fuel delivery system for a fuel-injected internal combustion engine, the method comprising:

supplying fuel from a tank to at least one fuel injector connected to the internal combustion engine for delivering fuel to the internal combustion engine, the supplying includes conveying the fuel through a conduit curving around a central axis, the conduit having a first end extending along a first axis, and fluidly communicating with a fuel supply line, and a second end extending along a second axis and fluidly communicating with a fuel rail coupled to the at least one fuel injector, wherein the first and second axes are fixed relative to each other and the central axis; and radially straightening and recurving the conduit with respect to the central axis in response to variations in fuel pressure within the coil.

7. The method according to claim 6, wherein the straightening and recurving comprises providing infinitesimal volumetric changes in the conduit.

8. The method according to claim 6, wherein the conduit comprises first and second portions of a fluid passageway, the first portion relative to the second portion is located radially outward with respect to the central axis and includes a first surface area, the second portion relative to the first portion is located radially inward with respect to the central axis and includes a second surface area, and the first surface area is larger than the second surface area such that an increase in the fuel pressure causes the straightening and such that a decrease in the fuel pressure causes the recurving.

9. The method according to claim 6, wherein the conduit comprises a tube.

* * * * *